US006283057B1

(12) United States Patent
Ellis et al.

(10) Patent No.: US 6,283,057 B1
(45) Date of Patent: Sep. 4, 2001

(54) BOAT WITH ARTICULATING BOW AND METHOD FOR ARTICULATING THE BOW OF A BOAT

(75) Inventors: Lawrence S Ellis, Slidell; Shawn Killeen, N.O., both of LA (US); Adrian Thompson, Eskadale (GB)

(73) Assignee: United States Marine, Inc., New Orleans, LA (US)

( * ) Notice: Subject to any disclaimer, the term of this patent is extended or adjusted under 35 U.S.C. 154(b) by 0 days.

(21) Appl. No.: 09/479,853

(22) Filed: Jan. 7, 2000

Related U.S. Application Data

(60) Provisional application No. 60/115,147, filed on Jan. 8, 1999.

(51) Int. Cl.[7] ..... B63B 7/04
(52) U.S. Cl. ..... 114/352; 114/77 R
(58) Field of Search ..... 114/70, 77 R, 114/353, 352, 354

(56) References Cited

U.S. PATENT DOCUMENTS

| | | | |
|---|---|---|---|
| 2,149,903 * | 3/1939 | Thompson | 114/353 |
| 3,129,443 | 4/1964 | Maturi et al. . | |
| 3,186,369 | 6/1965 | McLennan et al. . | |
| 4,366,769 | 1/1983 | Lingeman . | |
| 4,522,143 | 6/1985 | Holzbaur . | |
| 4,715,312 | 12/1987 | Bouvart . | |
| 4,869,194 | 9/1989 | Cummins . | |
| 5,642,686 | 7/1997 | Jeswine . | |

FOREIGN PATENT DOCUMENTS

| | | |
|---|---|---|
| 736273 | 6/1943 | (DE) . |

* cited by examiner

*Primary Examiner*—Jesus D. Sotelo
(74) *Attorney, Agent, or Firm*—Bracewell & Patterson, L.L.P.

(57) ABSTRACT

A boat with an articulating bow and a method for articulating the bow of a boat is provided which permits easier storage and transportation of the boat, without increasing the height of the boat when the bow is in its articulated open configuration, and the bow of the boat may be articulated while the boat is in a body of water.

31 Claims, 11 Drawing Sheets

BOAT WITH ARTICULATING BOW AND METHOD FOR ARTICULATING THE BOW OF A BOAT

RELATED APPLICATION

This application claimes the benefit of Provisional Patent Application Ser. No. 60/115,147, filed Jan. 8, 1999.

BACKGROUND OF THE INVENTION

1. Field of the Invention

The present invention relates to boats, and in particular, a boat having an articulated bow.

2. Description of Related Art

Various types of boat designs have been proposed which include providing boats composed of a plurality of sections which may be assembled to create a complete boat. Additionally, various boat designs exist wherein the bow of the boat may be pivoted, or articulated, with respect to another part of the boat. Typically, the bow is pivoted upwardly about an axis parallel with the earth's surface. Such articulation has been provided for various reasons, including permitting easier transportation and storage of the boat. It is believed that a disadvantage of many of the prior art designs is that the articulation may only be carried out while the boat is on dry land, or alternatively, can only be accomplished with the boat in the water with great difficulty. Another disadvantage of such designs is that if the total height of the boat is of concern from a transportation or storage perspective, such designs, wherein the bow articulates upwardly about a horizontally disposed axis may increase the overall height of the boat after the bow has been articulated, and can exceed the height restrictions imposed upon the size of the storage facility, or storage or stowage area. For example, in the case of pleasure craft which might be stored, or stowed, upon a much larger ship such as a yacht or ocean liner, it would be desirable to have the bow articulated to its open, or collapsed, position, thus shortening the length of the boat, prior to the pleasure craft being lifted upon the larger vessel, as by use of a crane or other similar type device.

If the boat is intended for operation at high speeds and/or in heavy seas, another potential disadvantage with prior art designs is that it is believed that such designs do not have the requisite strength characteristics to withstand the forces imposed upon the boat at high speeds and/or in rough seas. Additionally, the bow must also be rigidly secured to the remaining portion of the boat when the articulating bow is in its open and closed positions with respect to the remaining portion of the boat. It is believed that prior art designs do not adequately provide for such rigid securing.

Accordingly, prior to the development of the present invention, there has been no boat with an articulating bow, or method for articulating a bow of a boat, which: can be efficiently made and used on both land and in the water; is easy to transport and store; doe not increase the height of the boat when it is in its open, or collapsed, condition; and provides a secure and strong connection of the articulating bow to the remaining portion of the boat, so as to withstand the forces acting upon the boat when it is operating under high speeds and/or in heavy seas.

Therefore, the art has sought a boat with an articulating bow, and method for articulating the bow of a boat which: is efficiently made and used, regardless of whether or not the boat is in the water or on land; is easy to transport and store; does not increase the height of the boat when the boat is in its open, or collapsed, configuration; and provides a secure and strong connection between the bow and the remaining portion of the boat when the boat is operating at high speeds and/or in heavy seas.

SUMMARY OF THE INVENTION

In accordance with the invention, the foregoing advantages have been achieved with the boat and the method of articulating the bow of a boat of the present invention.

The boat of the present invention includes: a bow; a stem; at least one hinge associated with the bow and stern to attach the bow to the stem, whereby the bow may articulate about a substantially vertical axis; the bow being movable, while the boat is in a body of water, between a first closed, normal operating position, and a second, open position with the bow disposed beside the stern; and at least one lock member to lock the bow to the stern in the first closed, operating position. Another feature of the invention is that the stern may have a front and the bow may have a rear, the front of the stern having a stern bulkhead, which provides a substantially watertight seal to prevent water from entering the stern, and the rear of the bow having a bow bulkhead, which provides a substantially watertight seal to prevent water from entering the bow. A further feature of the present invention is that the at least one hinge decouples the bow from the stern from the first, closed operating position to the second, open position by first moving the bow in a forward direction, outwardly away from the stern. Another feature of the present invention is that a first outwardly extending flange may be disposed along the front of the stern, a second outwardly extending flange may be disposed along the rear of the bow, and one of the flanges mates with the other flange, when the bow is in the first, closed, operating position. An additional feature of the present invention is that the second flange of the bow may telescopically receive the first flange of the stern, when the bow is in the first, closed, operating position.

In accordance with another aspect of the present invention, the foregoing advantages have been achieved through the method of articulating the bow of a boat. The method for articulating a bow of a boat to a stern of the boat, about a substantially vertical axis, may include the steps of: associating at least one hinge with the bow and the stern; and the at least one hinge decouples the bow from the stern by first moving the bow in a forward direction outwardly away from the stern. Another feature of the method of the present invention may include the step of utilizing at least one multi-element hinge as the at least one hinge, and the at least one multi-element hinge may provide articulation of the bow with a compound locus. A further feature of the method of the present invention may include the steps of: providing the stern with a first outwardly extending flange disposed along the front of the stern; providing the bow with a second outwardly extending flange disposed along the rear of the bow; and one of the flanges mates with the other flange when the bow is in a first closed, operating position. A further feather of the method of the present invention may include the step of telescopically receiving the first flange of the stern within the second flange of the bow.

The boat and method for articulating the bow of a boat of the present invention, when compared with previously proposed prior art boat designs and articulation methods, have the advantages of: being easily made and used, regardless of whether or not the boat is on land or in the water; being easier to transport and store because of the reduced length of the boat; not increasing the height of the boat when the bow has been articulated and the boat is in its open, or collapsed, configuration; and providing a secure, rigid, and strong connection between the bow and the remaining portion of the boat when the boat is used at high speeds and/or in heavy seas.

While the invention will be described in connection with the preferred embodiments, it will be understood that it is not intended to limit the invention to those embodiments. On the contrary, it is intended to cover all alternatives, modifications, and equivalents, as may be included within the spirit and scope of the invention as to be defined by the claims to be filed in a counterpart, non-provisional application.

DETAILED DESCRIPTION AND SPECIFIC EMBODIMENTS

Figure 1:
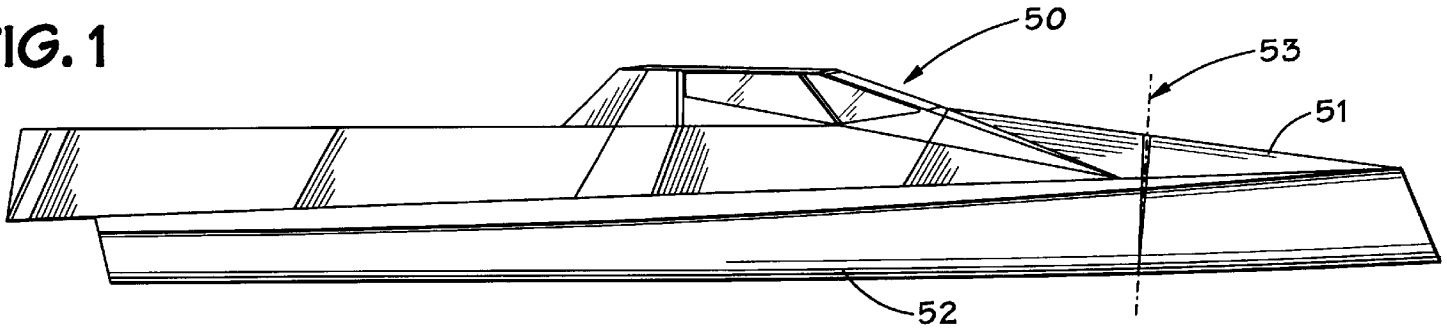
FIG. 1 is a side view of a boat in accordance with the invention.
Figure 2:
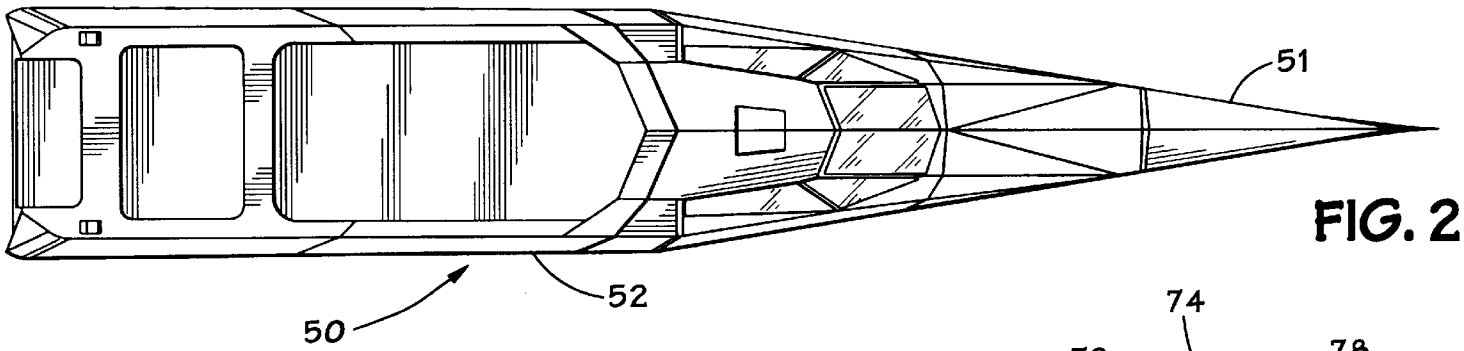
FIG. 2 is a top view of the boat of FIG. 1.

With reference to FIGS. 1–4 and FIGS. 6–9, a boat 50, in accordance with the present invention, is illustrated, wherein the bow 51 of boat 50 maybe articulated, or pivoted, between its closed, or normal operating, configuration illustrated in FIGS. 1–4, to its open, or collapsed, configuration illustrated in FIGS. 6–9. Boat 50 is illustrated in an intermediate, open, configuration in FIGS. 11–14. The rear, stern or remaining portion 52 of boat 50 is that portion of boat 50 disposed behind, or aft, of the bow 51. The bow 51 is articulated, or pivots, about a substantially vertical axis 53 as shown in FIG. 1, as will be hereinafter described in greater detail. Boat 50 may be of any construction or made of any material, having the requisite strength and durability characteristics to permit boat 50 to function as a boat in either fresh water or sea water environments. For example, boat 50 may have the configuration illustrated in FIGS. 1–4, 6–8, and 11–14, or any other desired configuration. Any suitable propulsion system (not shown) may be utilized to provide movement of boat 50, such as an inboard, or outboard, motor or motors (not shown) as is known in the art. Boat 50 may be manufactured of any suitable material, such as steel, aluminum, fiberglass, or any material having the requisite strength characteristics to permit boat 50 to function as a boat and to operate in the manner as to be hereinafter described. As will be hereinafter described, boat 50 may be disposed to and from its open and closed positions illustrated in FIGS. 1–4, 6–9, and 11–14 while the boat is upon dry land such as on a trailer; upon a larger vessel, such as a yacht or ocean liner; or while boat 50 is in the water, such as a lake or ocean (not shown).

Turning now to FIGS. 16–22, disposed at the front 55 (FIG. 22) of the remaining portion 52 of boat 50 is a boat, or stern, bulkhead 56, which provides a substantially watertight seal to prevent water from entering the remaining, or stern, portion 52 of boat 50. Similarly, the rear 57 of bow 51 is provided with a bow bulkhead 58 which provides a substantially watertight seal to prevent water from entering bow 51. An outwardly extending integral flange, or boat flange, 59 is disposed along the periphery of the front 55 of boat 50, extending outwardly from boat bulkhead 56. Similarly, the rear 57 of bow 51 is provided with an outwardly extending bow flange 60 extending about the periphery of the rear 57 of bow 51, extending outwardly from bow bulkhead 58. When bow 51 is in its closed configuration illustrated in FIG. 16, boat flange 59 is preferably telescopically received within bow flange 60. Alternatively, bow flange 60 could be telescopically received within boat flange 59. The width W of the bow flange 60 (FIG. 22) and the width W' of the boat flange 59 (FIG. 22) are relatively wide, in order to provide a strong and secure connection between the bow 51 and the remaining portion, or stern portion, 52 of boat 50, when boat 50 is in its closed configuration illustrated in FIG. 16. Preferably, the flanges 59, 60 are disposed in a close fitting and mating relationship, whereby they are in sliding abutting contact with each other. Thus, the mating flanges 59, 60, are able to withstand the impact loads exerted upon the bow 51, when boat 50 is operating at high speeds and/or in rough seas.

Bow 51 articulates, or pivots, about axis 53 (FIG. 1), with respect to the remaining portion 52 of boat 50 through the use of at least one, and preferably a plurality of hinges 70, as illustrated in FIGS. 5, 10, 15, and FIGS. 23–36. Preferably, as illustrated in FIGS. 8 and 19–22, two hinges 70, vertically spaced from each other, are utilized, although additional hinges could be utilized. Because of the telescoping nature of the connection between boat flange 59 and bow flange 60, it is necessary that hinges 70 operate to first decouple the bow 51 from the remaining portion 52 of boat 50 by movement of the bow 51 in a forward direction, outwardly away from boat bulkhead 56. Thus, flanges 59 and 60 clear each other, so as not to be in interfering, non-sliding contact with each other, prior to bow 51 being articulated, or pivoted, about axis 53 (FIGS. 19–22). Hinges 70 must also function so as to move bow 51 outwardly far enough away from the remaining portion 52 of boat 50 for the bow 51 to clear the remaining portion 52 of boat 50 when bow 51 is in its open, or collapsed configuration illustrated in FIG. 22. Additionally, hinges 70 must prevent bow 51 from twisting or turning in any other direction, other than about axis 53. Accordingly, hinges 70 are preferably multi-element hinges 71, which permit the functioning of hinges 70 in accordance with the foregoing operating parameters.

Figure 5:
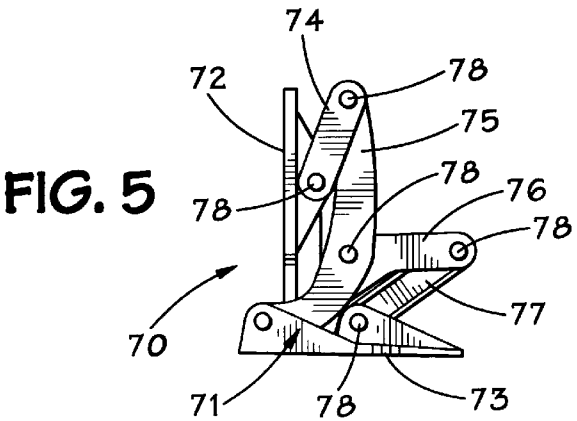
FIG. 5 is a top view of a hinge, in accordance with the present invention, in its configuration when the bow is in its closed configuration illustrated in FIGS. 1–4.
Figure 3:
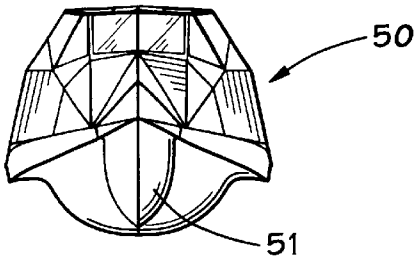
FIG. 3 is a front view of the boat of FIG. 1.
Figure 4:
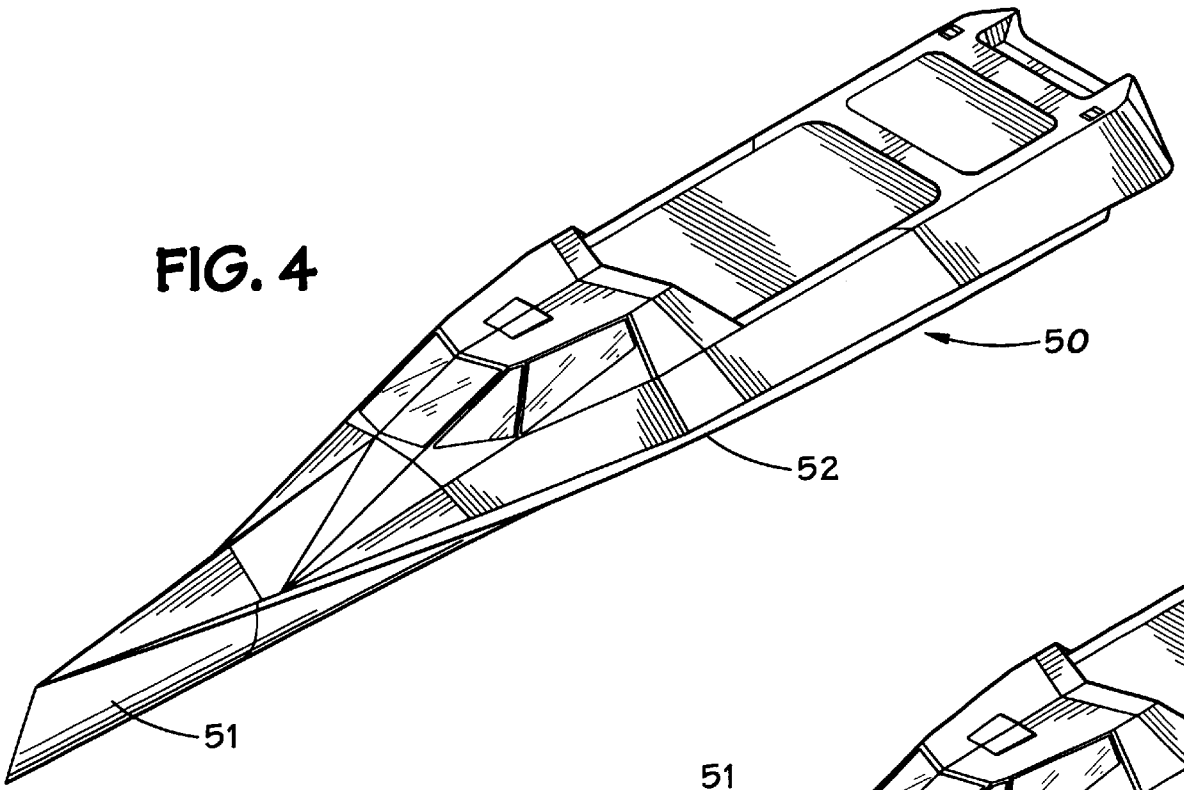
FIG. 4 is a perspective view of the boat of FIG. 1.
Figure 9:
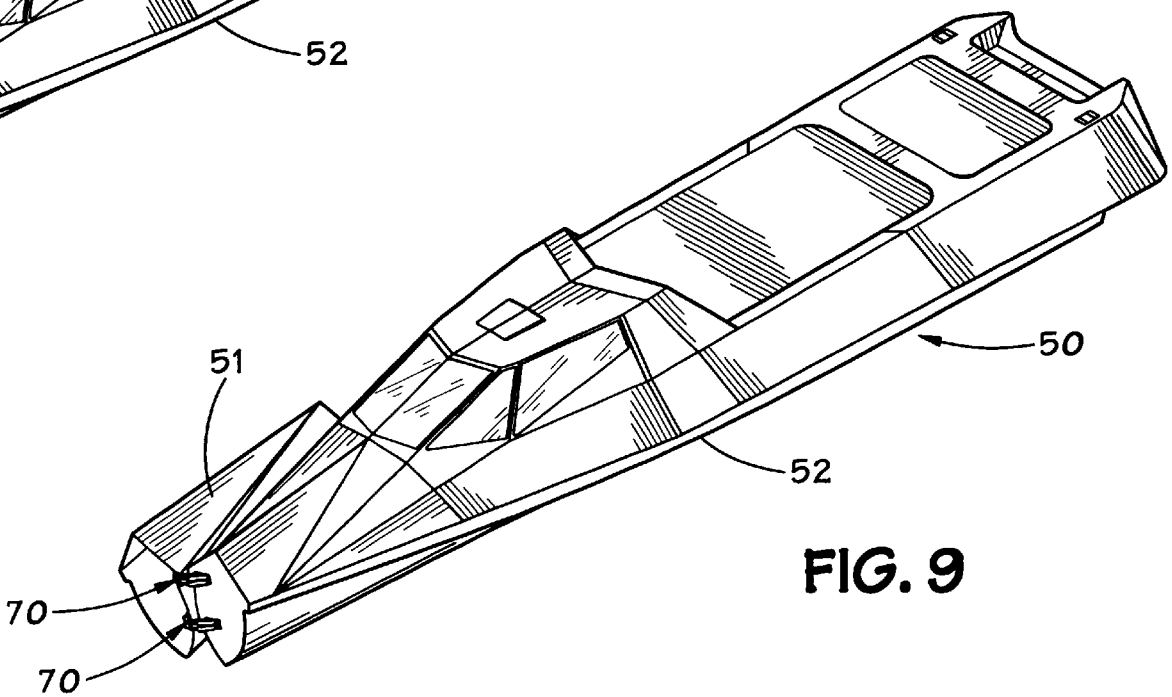
FIG. 9 is a perspective view of the boat of FIG. 6.
Figure 6:
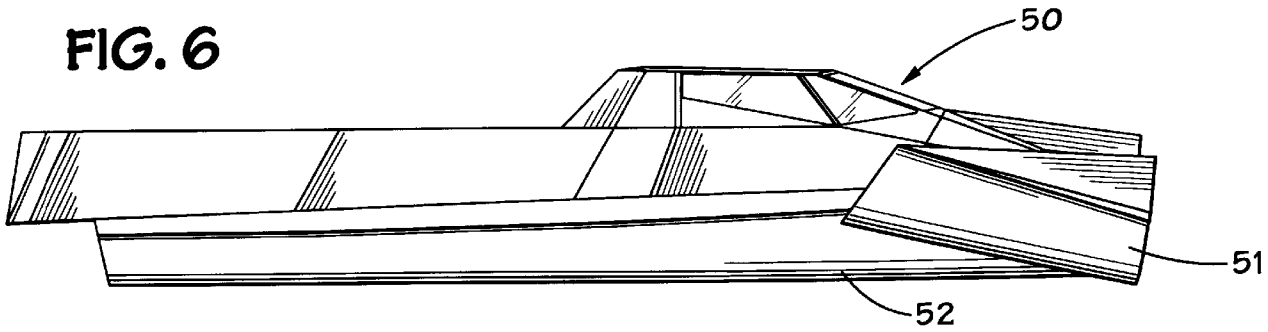
FIG. 6 is a side view of the boat of FIG. 1, when the bow has been articulated to its open, or collapsed, configuration.
Figure 7:
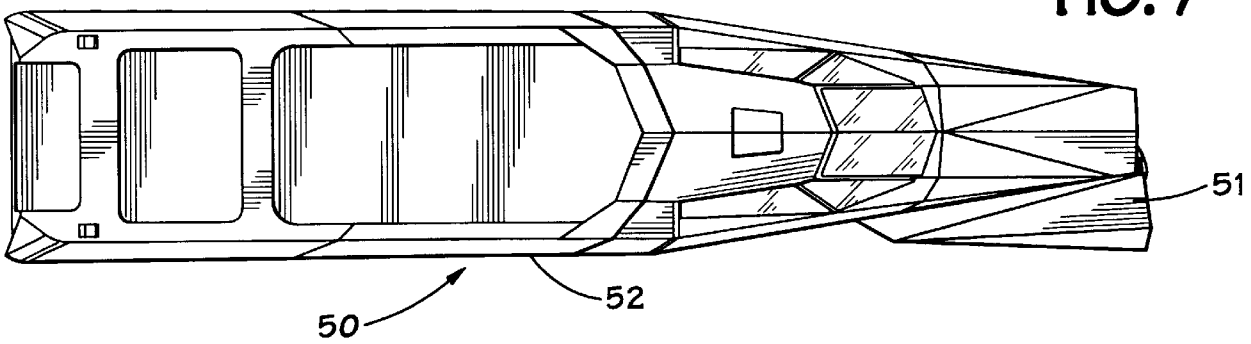
FIG. 7 is a top view of the boat of FIG. 6.
Figure 22:
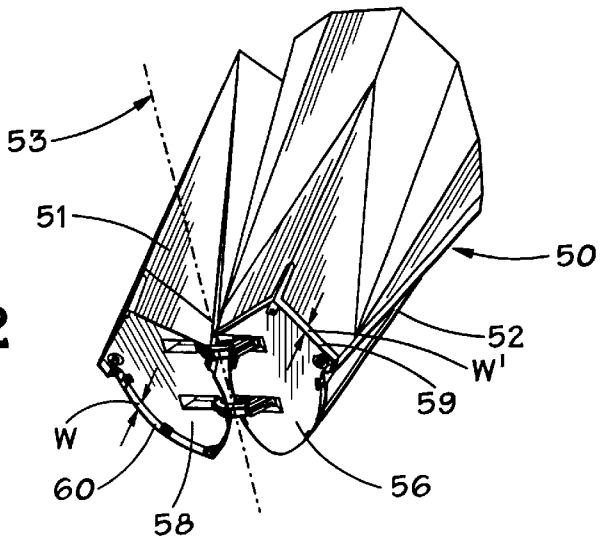
Figure 19:
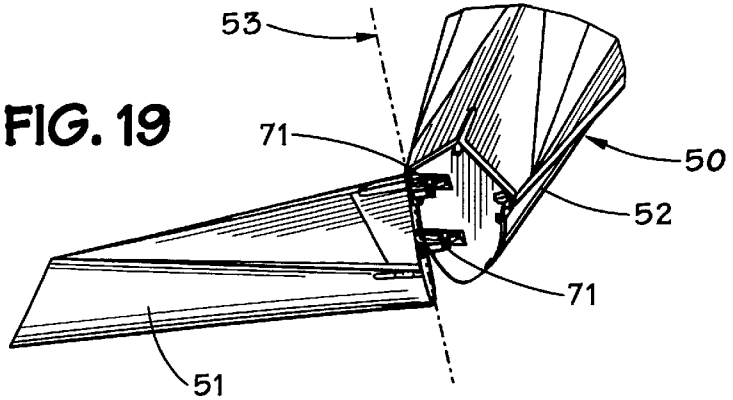
Figure 21:
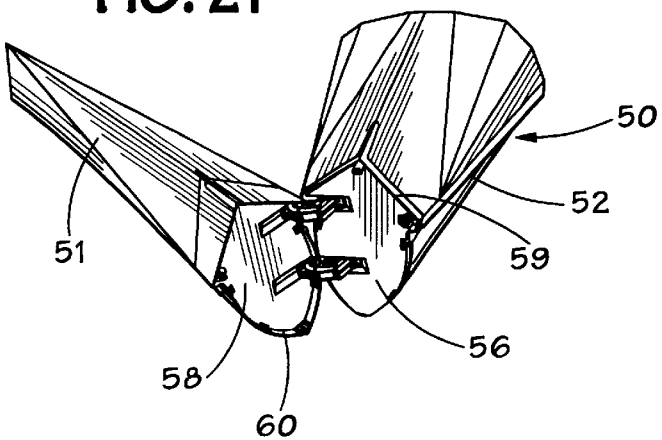
Figure 23:
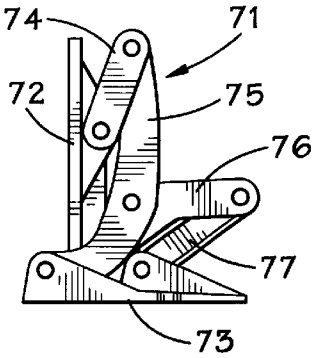
FIGS. 23–29 are top views of the hinge of FIG. 5, when the articulated bow is in the configuration illustrated in the figures, FIGS. 16–22, appearing below each of the foregoing figures, FIGS. 23–29.
Figure 24:
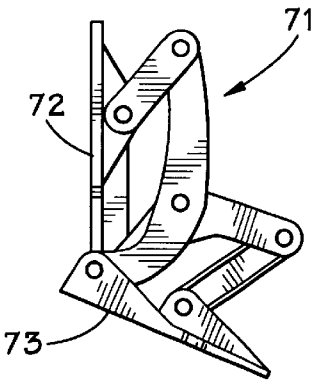
Figure 25:
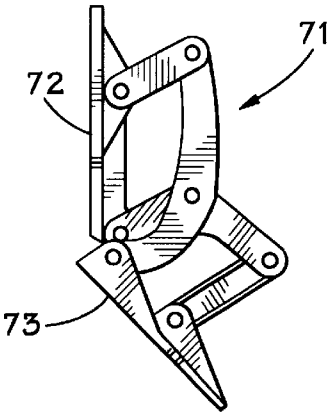
Figure 26:
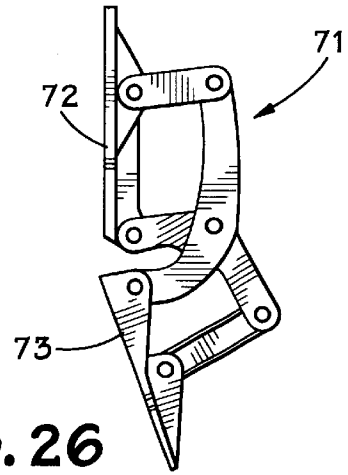
Figure 27:
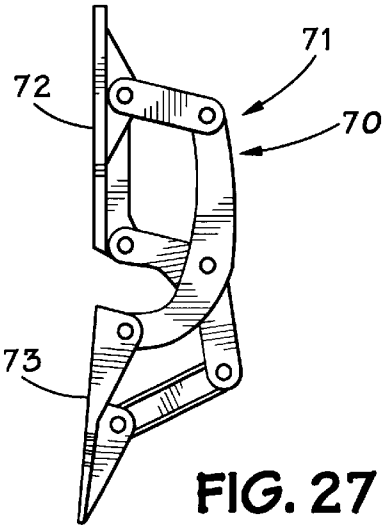
Figure 28:
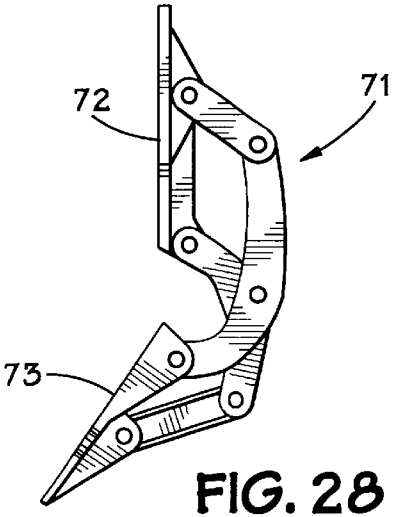
Figure 29:
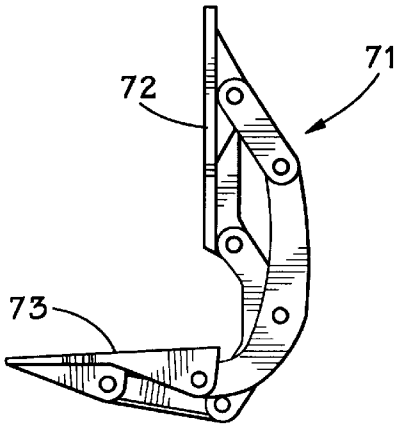
Figure 33:
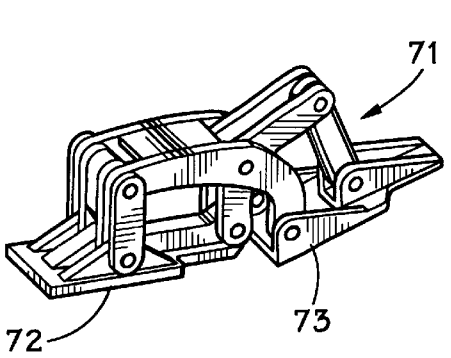
FIGS. 30–36 are perspective views of the hinge of FIG. 5 when the articulating bow is in the configuration illustrated in the figures, FIGS. 16–22, appearing below each of the foregoing figures, FIGS. 30–36.
Figure 32:
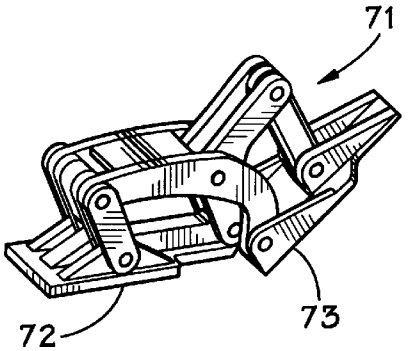
Figure 31:
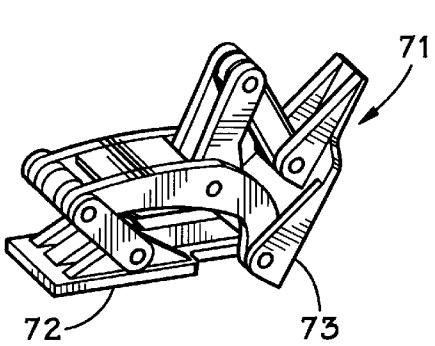
Figure 30:
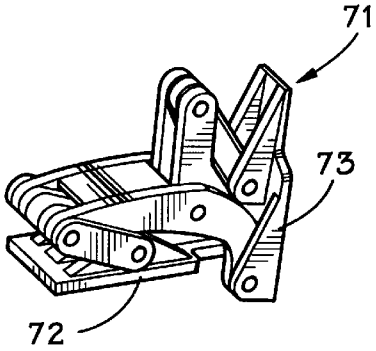
Figure 36:
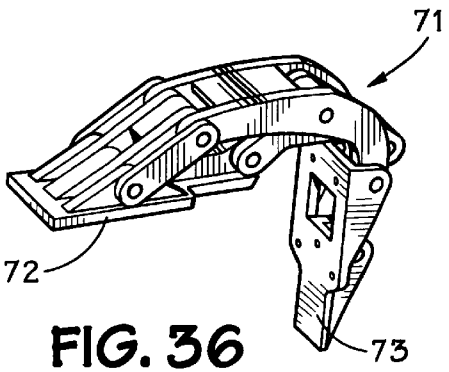
Figure 35:
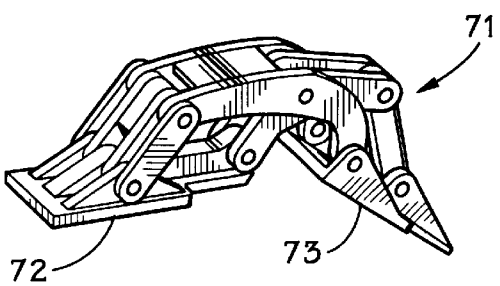
Figure 34:
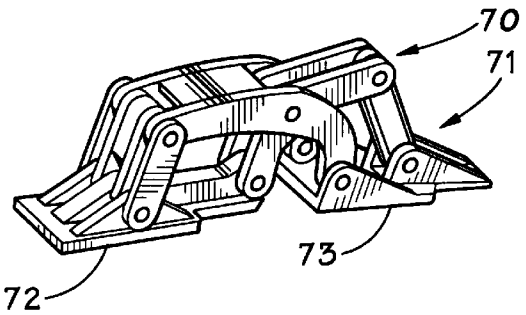

Hinges 71, in FIGS. 5, 23, and 30, are illustrated in their configuration when bow 51 is in its closed configuration with respect to the stern portion 52 of boat 50, as illustrated in FIGS. 1–4 and FIG. 16. Multi-element hinges 71 each preferably includes a boat, or stern, attachment plate 72, a bow attachment plate 73, the boat and bow attachment plates 73 being hingedly connected to each other by four pairs of hinge connector members 74–77, which are pivoted to each other via a plurality of hinge pins 78. Boat attachment plates 72 of hinges 71 are rigidly, and fixedly, attached to an interior wall surface (not shown) of the remaining portion, or stern, portion 52 of boat 50 aft, or behind, boat bulkhead 56. Boat bulkhead 56 is provided with suitable openings 80 (FIG. 20) through which hinge connector members 74–77 may pass through into the remaining, or stern portion, 52 of boat 50, as the bow 51 is articulated, or pivoted, into its closed position illustrated in FIG. 16. Bow attachment plate 73 is fixedly, and rigidly, secured to the bow bulkhead 58. Boat attachment plate 72 and bow attachment plate 73 may be rigidly secured to the other portion 52 of boat 50 and bow bulkhead 58 respectively, in any suitable manner as by screws, bolts, welding, provided a rigid and secure attachment is obtained. The relative dispositions between boat attachment plates 72, bow attachment plates 73 and hinge connector members 74–77 are illustrated in FIGS. 23–36 for the configuration of bow 51 with respect to the other portion 52 of boat 50 as illustrated in FIGS. 16–22.

Figure 8:
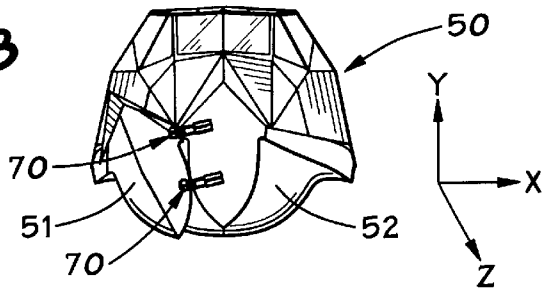
FIG. 8 is a front view of the boat of FIG. 6.
Figure 10:
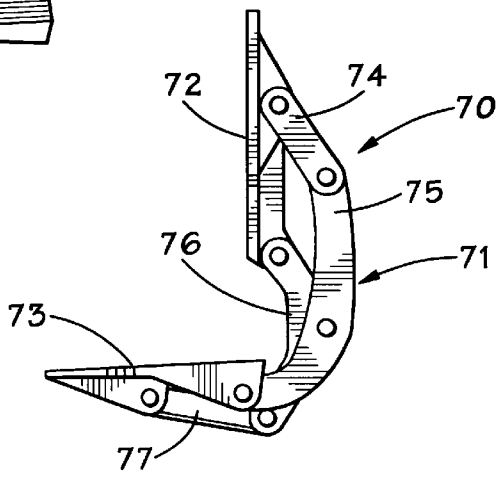
FIG. 10 is a top view of the hinge of FIG. 5 when the bow of the boat of FIG. 6 is in its open, or collapsed, configuration shown in FIGS. 6–9.
Figure 11:
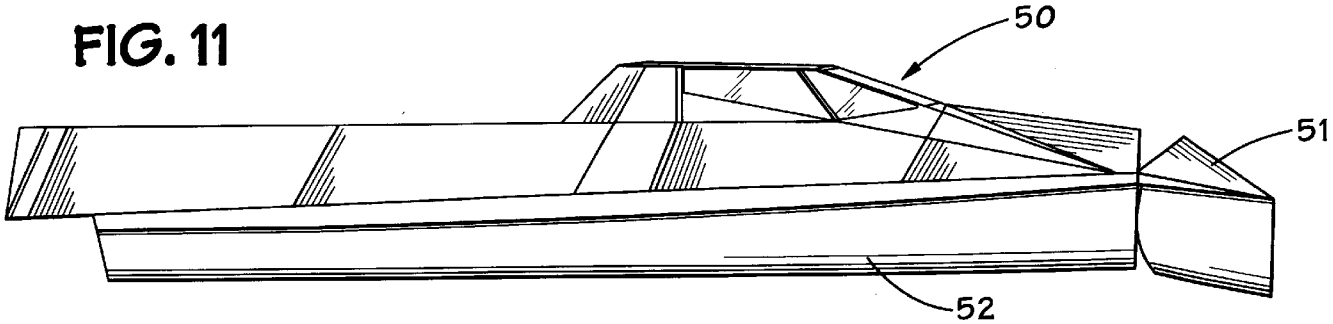
FIG. 11 is a side view of the boat of FIG. 1, when the bow of the boat is in a partially open position.
Figure 12:
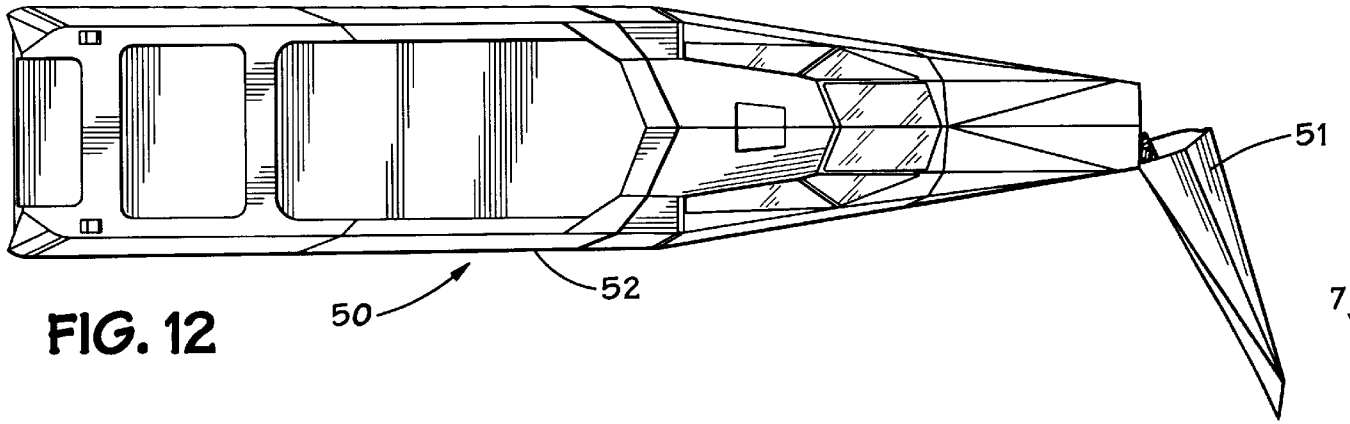
FIG. 12 is a top view of the boat of FIG. 11.
Figure 13:
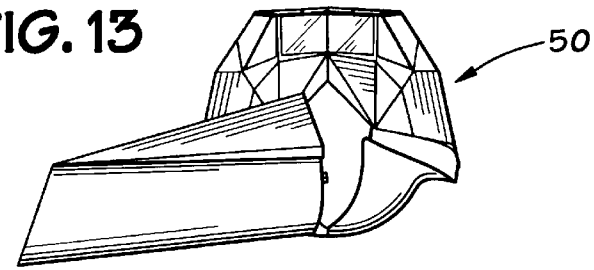
FIG. 13 is a front view of the boat of FIG. 11.
Figure 15:
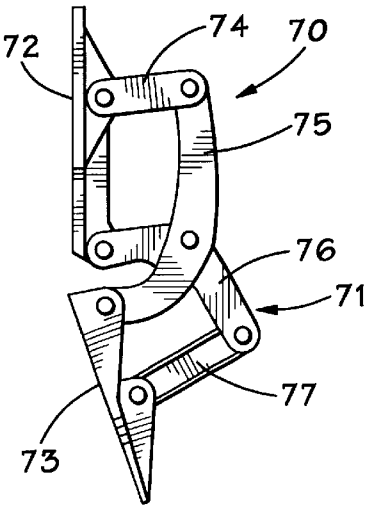
FIG. 15 is a top view of the hinge of FIG. 5, when the articulating bow is in the partially open position illustrated in FIGS. 11–13.
Figure 16:
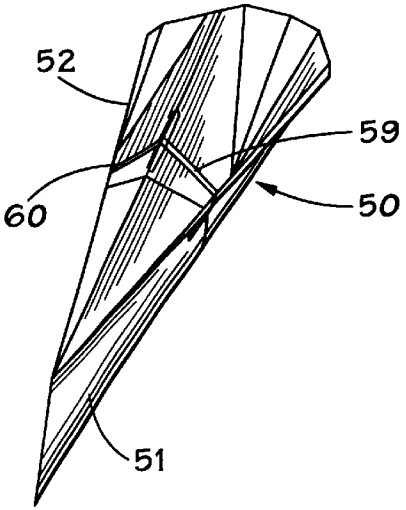
FIG. 16 is a partial, perspective view of the boat of FIG. 1 when the articulating bow is in its closed position illustrated in FIG. 1.
Figure 20:
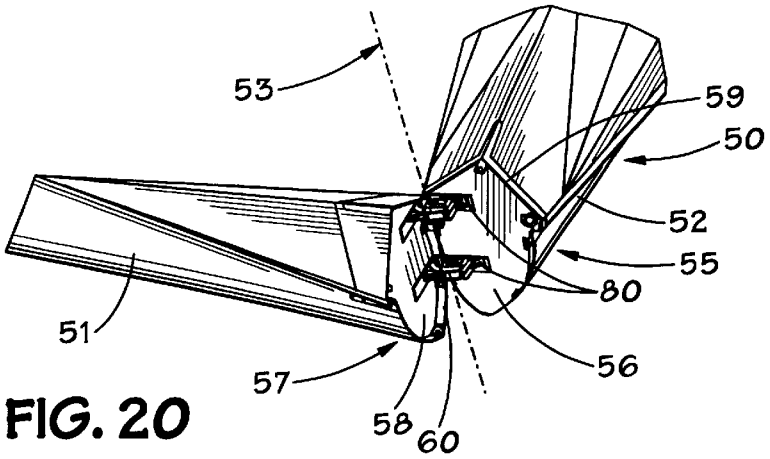

In the embodiment illustrated of boat 50 in accordance with the present invention, bow 51 pivots, or articulates through an angle of approximately 176° degrees between its closed configuration of FIG. 16 to its open configuration of FIG. 22 about axis 53. In this regard, axis 53 is shown in the figures for illustrative purposes only since, because hinges 71 are multi-element hinges, there is no specific axis for the articulation, or pivoting, of bow 51. Rather the articulation, pivoting, or rotation of bow 51 has a compound locus which is determined by the geometry of the individual hinge elements 72–77. For the specific embodiment of boat 50 illustrated in the present application, axis 53 of FIG. 1 is described as being substantially vertical; however, as seen in FIG. 1, the break point, or connection between bow 51 and the other portion 52 of the boat 50 slopes slightly inwardly toward the other portion 52 of boat 50. Additionally, in the specific embodiment of boat 50 illustrated in the figures, the hinges 71 do not lie in planes which are perfectly parallel or perpendicular to the xyz axes of boat 50 (FIG. 8). In a preferred embodiment of the present invention, hinges 70 are mounted in boat 50 at an angle of approximately 5.42° degrees pitch, 11.30° degrees roll, and 11.0° degrees yaw, relative to the xyz axes of boat 50.

Figures 14, 37:
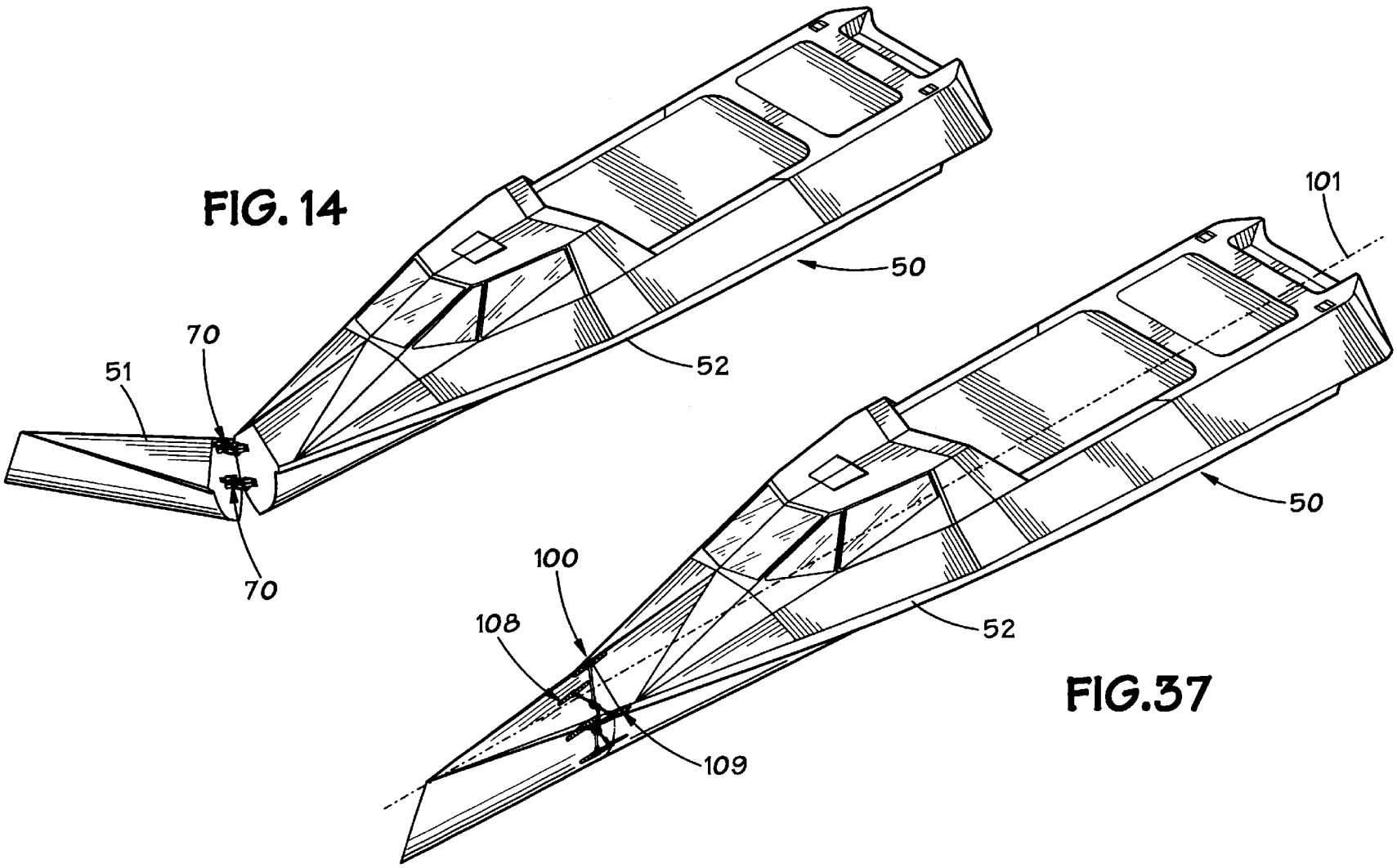
FIG. 14 is a perspective view of the boat of FIG. 11.
FIG. 37 is another perspective view of the boat of FIG. 1, in accordance with the present invention, the boat shown as being transparent.
Figure 18:
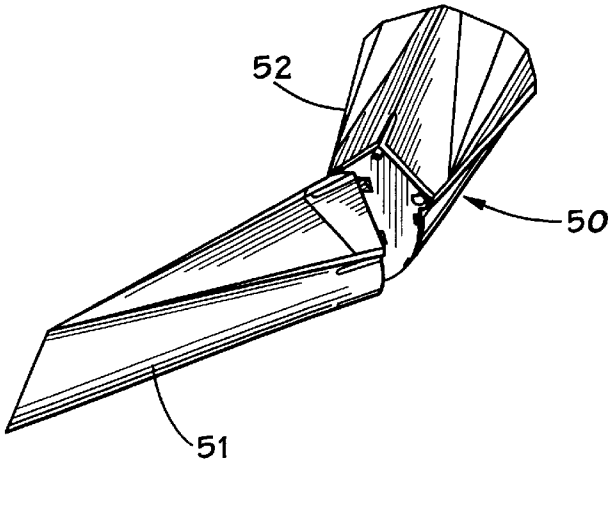
FIGS. 17–22 are partial, perspective views of the articulating bow of FIG. 16 as the bow is articulated from its closed position of FIG. 16 to its open, or collapsed, configuration illustrated in FIG. 22, FIG. 22 corresponding to the configuration of the boat of the present invention, as illustrated in FIGS. 6–9, and FIG. 19 corresponding to the configuration of the articulating bow of the boat as illustrated in FIGS. 11–14.
Figure 17:
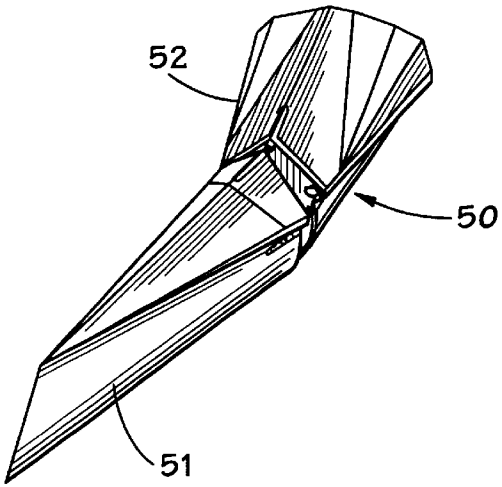

With reference now to FIGS. 37–40, the locking mechanism 100 which locks bow 51 to the other portion 52 of boat 50 will be described. For purposes of illustration, boat 50 in FIG. 37 is a transparent view of boat 50 to better illustrate the disposition of locking mechanism 100 within boat 50. Locking mechanism 100 is disposed behind, or aft, of boat bulkhead 56 (FIG. 20) and is generally disposed in a plane which is perpendicular to the longitudinal axis 101 of boat 50. Preferably, locking mechanism 100 is mounted to the aft face of the boat bulkhead 56.

Figure 39:
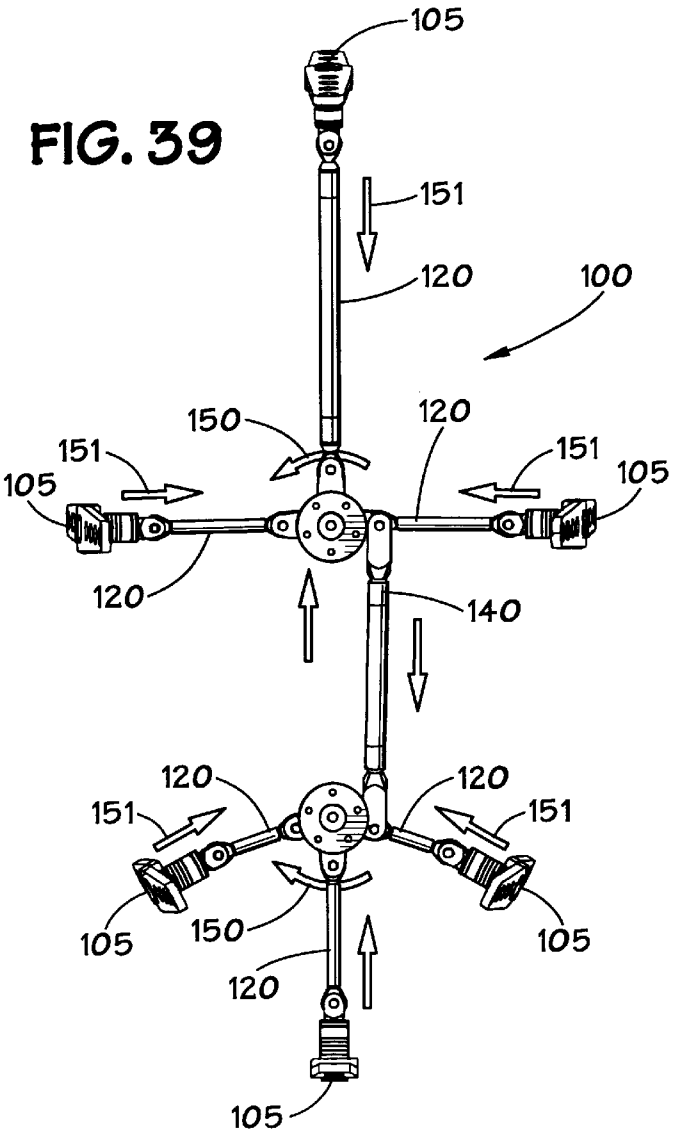
FIG. 39 is a front view of the locking mechanism of FIG. 38.
Figure 38:
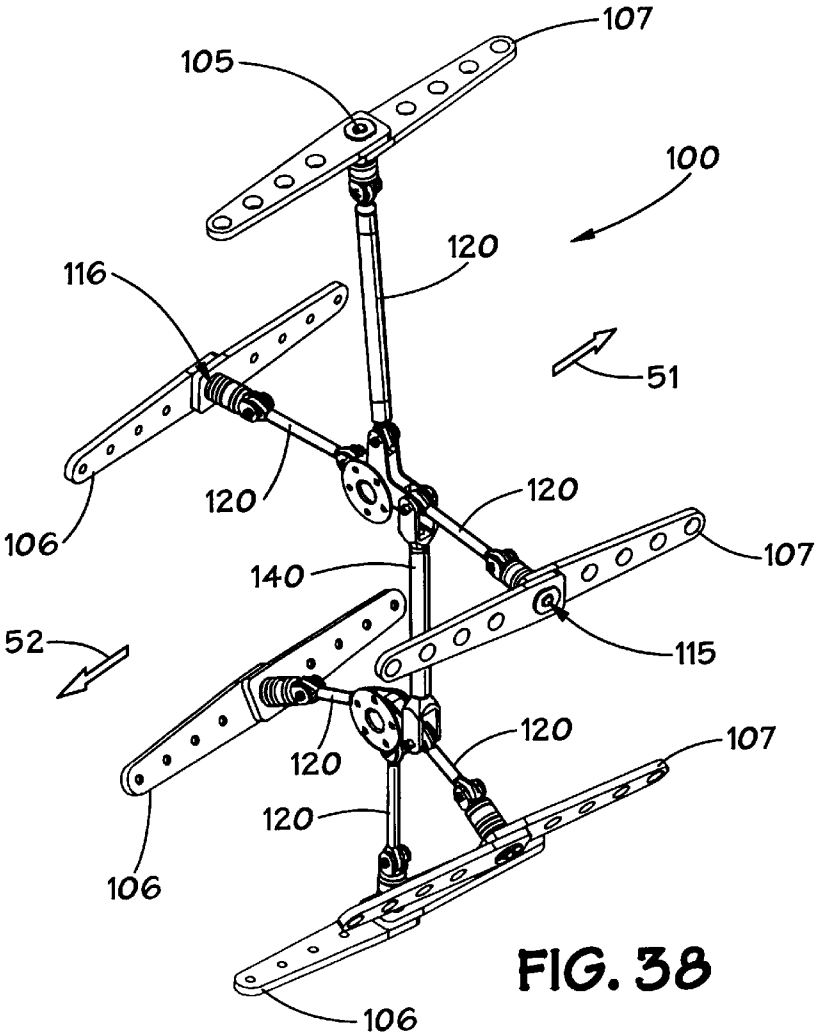
FIG. 38 is a perspective view of a locking mechanism used in accordance with the present invention.
Figure 40:
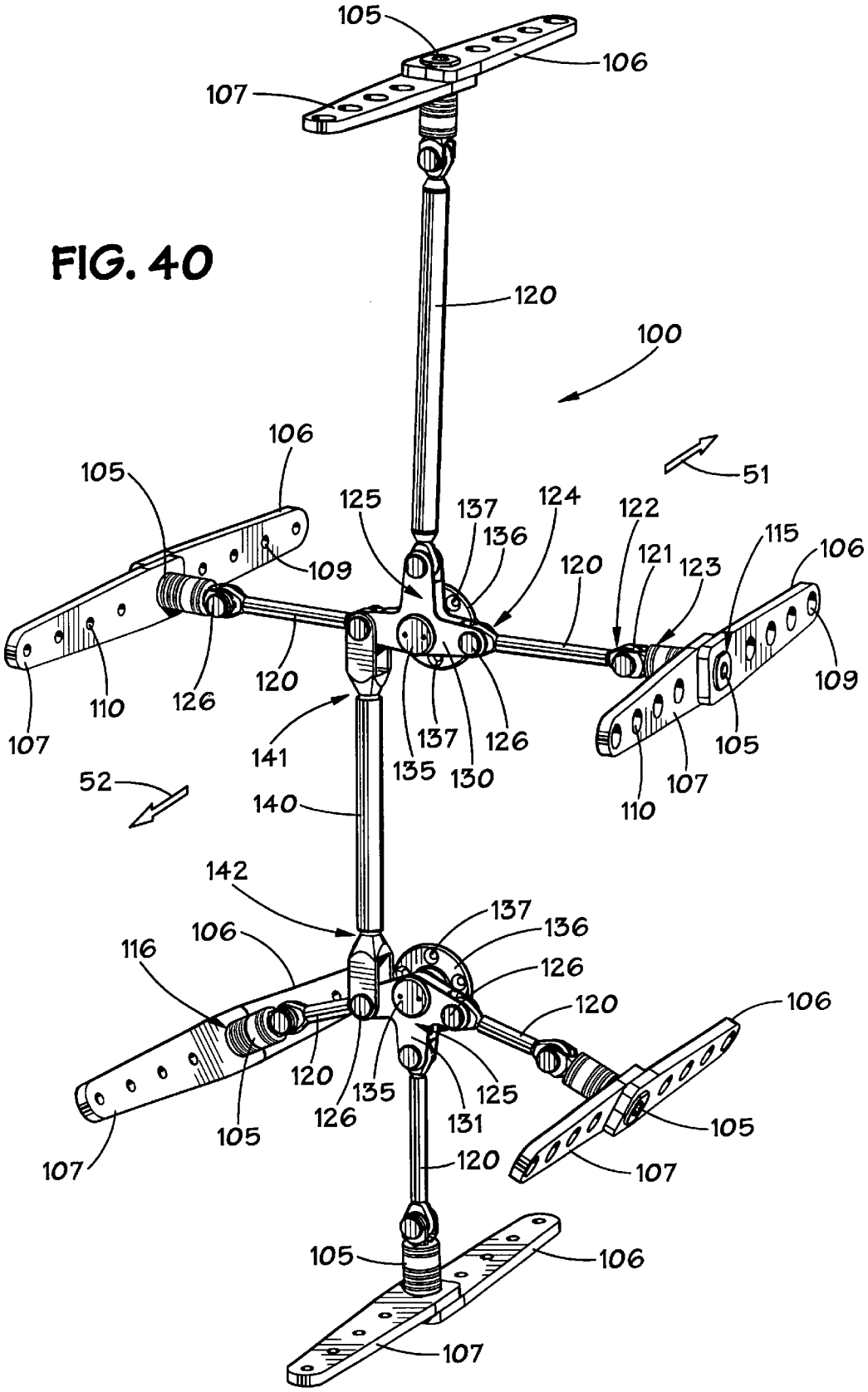
FIG. 40 is a perspective view of the locking mechanism of FIG. 38, FIG. 40 being an enlarged mirror image of FIG. 38.

As seen in FIGS. 38–40, locking mechanism 100 generally includes at least one, and preferably a plurality of locking pins 105 which cooperate with a plurality of bow locking plates, or straps, 106, and boat, or stern, locking plates, or straps, 107. The plurality of bow locking plates 106 are fixedly secured to an interior surface 108 (FIG. 37) of bow 51, in any suitable manner, such as by welding, bolts, or screws (not shown). Bow locking plates 106 may be provided with a plurality of openings 109 to accommodate bolts or screws. Similarly, boat locking plates 107 are fixedly secured to an interior surface 109 (FIG. 37) of the other, or stern, portion 52 of boat 50, in any suitable manner, such as be welding, screws, or bolts (not shown). Boat locking plates 107 may be similarly provided with a plurality of openings 110 to accommodate the screws or bolts. When the bow 51 is in its closed configuration illustrated in FIG. 37, locking pins 105 pass through locking openings 115 disposed in each of the bow locking plates 106 and mating locking openings 116 formed in boat locking plates 107, as illustrated in FIGS. 38–40. The configuration of locking openings 115 and 116 preferably closely conform to the cross-sectional configuration of locking pins 105, so that relative movement between boat locking plates 107 and bow locking plates 106 is severely restricted when locking pins 105 are engaged and pass through both locking openings 115 and 116. Locking pins 105 may have any cross-sectional configuration, provided it can be inserted through locking openings 115, 116. Preferably, the shape of locking openings 115 and 116 closely conforms to the cross-sectional configuration of locking pins 105, but locking openings 115, 116, could have other configurations which permit the passage of locking pins 105 therethrough, while still restricting relative movement between bow locking plates 106 and boat locking plates 107. In the preferred embodiment of boat 50 illustrated in the present application, six locking pins 105 are preferably provided, although a larger or smaller number of locking pins 105 could be utilized.

Still with reference to FIGS. 38–40, it is seen that at least one, and preferably each, locking pin 105 is associated with a connector arm 120 through a pivot connection 121 disposed at the first end 122 of connector arm 120 and the rear end 123 of locking pin 105. The second end 124 of each connector arm 120 is associated with a rotatable boss 125, by use of a pivot connection 126 at the second end 124 of each connector arm 120. As shown in FIGS. 38–40, three connector arms 120 and their associated locking pins 105 are pivotably associated with an upper rotatable boss 130, and three connector arms 120 and their associated locking pins 105 are associated with a lower locking boss 131. The specific configuration for upper and lower locking bosses 130 and 131 is generally dictated by the cross-sectional configuration of boat 50 at the point at which locking mechanism 100 is secured to boat 50. Accordingly, it is seen that the shape of the lower rotatable boss 131 differs slightly from the shape of the upper rotatable boss 130; however, the general operation and functioning of each of the bosses 130 and 131 is identical. Each boss 130, 131 is rotatably mounted about a pivot pin 135 which is affixed to a boss mounting plate 136 that is secured to the rear, or aft, face of boat bulkhead 56, as by a plurality of screws or other fasteners (not shown). The boss mounting plates being provided with a plurality of openings 137 to accommodate such bolts or screws.

A boss connector arm 140 is journalled at it upper end 141 to upper rotatable boss 130, and its lower end 142 is journalled to lower rotatable boss 131. Accordingly, upon movement of boss connector arm 140 in an upward or downward direction, such movement will cause the bosses 125 to rotate. Upon rotation of bosses 130, 131 in the direction of arrows 150 (FIG. 39), connector arms 120 are caused to move in the direction shown by arrows 151 (FIG. 39) which causes the retraction, or disengagement, of locking pins 105 with bow and boat locking plates 106, 107. After locking pins 105 have been disengaged, bow 51 may be articulated with respect to boat 50 in the manner previously described. Boss connector arm 140 may be actuated, or powered, by any suitable device (not shown) which causes the desired movement of boss connector arm 140. Preferably, a conventional hydraulic actuator is used to cause the movement of boss connector arm 140. Similarly, any suitable device may be utilized to cause the pivoting, or articulation, of bow 51, including the initial forward movement of bow 51 as previously described. Preferably, hydraulic actuators (not shown) are associated with hinges 70 to cause the desired movement of bow 51. When locking pins 105 are in their engaged configuration with bow and boat locking plates 106, 107, as previously described, bow 51 is firmly closed with respect to the other portion 52 of boat 50 and bow 51 is firmly secured to permit substantially no relative movement of bow 51 with respect to the other portion 52 of boat 50. Additionally, boat and bow flanges 59, 60 are kept in a relatively tight and close abutting, sliding relationship with respect to each other. When locking pins 105 are engaged with bow and boat locking plates 106, 107 hinges 70 are de-loaded, in that no loading forces are exerted upon hinges 70.

The bow 51 of boat 50 of the present invention may be easily articulated to and from its open and closed configuration while boat 50 is in a body of water, as well as while on land.

What is claimed:

1. A boat, comprising:

a bow, having a rear, the rear of the bow having a bow bulkhead, which provides a substantially watertight seal to prevent water from entering the bow;

a stern, having a front, the front of the stern having a stern bulkhead which provides a substantially watertight seal to prevent water from entering the stern;

at least one hinge associated with the bow and the stern to attach the bow to the stern, whereby the bow may articulate about a substantially vertical axis;

the bow being moveable, between a first closed, normal operating position, and a second, open position with the bow disposed beside the stern;

at least one lock member to lock the bow to the stern in the first, closed, operating position; and at least one flange associated with the front of the stern and the back of the bow when the bow is in the first, closed, operating position.

2. The boat of claim 1, wherein the at least one flange includes a first outwardly extending flange disposed along the front of the stern, and the bow is received within the first outwardly extending flange, when the bow is in the first, closed, operating position.

3. The boat of claim 1, wherein the at least one flange includes a second outwardly extending flange disposed along the rear of the bow, and the stern is received within the second outwardly extending flange, when the bow is in the first, closed, operating position.

4. The boat of claim 1, wherein the at least one flange includes a first outwardly extending flange disposed along the front of the stern, and a second outwardly extending flange disposed along the rear of the bow and one of the flanges mates with the other flange, when the bow is in the first, closed, operating position.

5. The boat of claim 4, wherein the second flange of the bow telescopically receives the first flange of the stern, when the bow is in the first, closed, operating position.

6. The boat of claim 1, wherein the at least one hinge decouples the bow from the stern from the first, closed operating position to the second, open position by first moving the bow in a forward direction, outwardly away from the stern.

7. The boat of claim 6, wherein the at least one hinge is at least one multi-element hinge.

8. The boat of claim 7, wherein the at least one multi-element hinge includes a stern attachment plate and a bow attachment plate, connected by a plurality of hinge connector members which are pivoted to each other.

9. The boat of claim 7, wherein the at least one multi-element hinge provides articulation of the bow with a compound locus.

10. The boat of claim 1, wherein the at least one back member is at least one locking pin which cooperates with at least one bow locking plate and at least one stern locking plate, the at least one bow locking plate fixedly secured to the bow and the at least one stern locking plate fixedly secured to the stern, the at least one locking pin being received in a locking opening formed in each of the locking plates.

11. The boat of claim 10, wherein there are a plurality of locking pins and locking plates, and at least some of the locking pins are each associated with a connector arm and each connector arm is associated with a rotatable boss.

12. The boat of claim 11, wherein there are two rotatable bosses connected by a boss connector arm.

13. A method for articulating a bow of a boat to a stern of the boat, about a substantially vertical axis, comprising the steps of:

associating at least one hinge with the bow and the stern; and the at least one hinge decouples the bow from the stern by first moving the bow in a forward direction outwardly away from the stern.

14. The method of claim 13, including the step of utilizing at least one multi-element hinge as the at least one hinge.

15. The method of claim 14, including the step of the at least one multi-element hinge providing articulation of the bow with a compound locus.

16. The method of claim 13, including the step of pivoting the bow about the substantially vertical axis, which has a compound locus, to a position wherein the bow is beside the stern.

17. The method of claim 13, including the steps of:

a) providing the stern with a first outwardly extending flange disposed along the front of the stern; and b) when the bow is in a first, closed operating position, receiving the bow within the first outwardly extending flange.

18. The method of claim 13, including the steps of:

a) providing the bow with a second outwardly extending flange disposed along the rear of the bow; and b) when the bow is in a first, closed operating position, receiving the stern within the second outwardly extending flange.

19. The method of claim 13, including the steps of:

a) providing the stern with a first outwardly extending flange disposed along the front of the stern;

b) providing the bow with a second outwardly extending flange disposed along the rear of the bow; and c) one of the flanges mates with the other flange when the bow is in a first closed, operating position.

20. The method of claim 19, including the step of telescopically receiving the first flange of the stern within the second flange of the bow.

21. A boat, comprising:

a bow;

a stern;

at least one hinge associated with the bow and the stern to attach the bow to the stern, whereby the bow may articulate about a substantially vertical axis;

the bow being moveable, while the boat is in a body of water, between a first closed, normal operating position, and a second, open position with the bow disposed beside the stern; and at least one lock member to lock the bow to the stern in the first, closed, operating position.

22. The boat of claim 21, wherein a first outwardly extending flange is disposed along the front of the stern, and the bow is received within the first outwardly extending flange, when the bow is in the first, closed, operating position.

23. The boat of claim 21, wherein a second outwardly extending flange is disposed along the rear of the bow, and the stern is received within the second outwardly extending flange, when the bow is in the first, closed, operating position.

24. The boat of claim 22, wherein a first outwardly extending flange is disposed along the front of the stern, a second outwardly extending flange is disposed along the rear of the bow and one of the flanges mates with the other flange, when the bow is in the first, closed, operating position.

25. The boat of claim 24, wherein the second flange of the bow telescopically receives the first flange of the stern, when the bow is in the first, closed, operating position.

26. The boat of claim 21, wherein the at least one hinge is at least one multi-element hinge.

27. The boat of claim 26, wherein the at least one multi-element hinge includes a stern attachment plate and a bow attachment plate, connected by a plurality of hinge connector members which are pivoted to each other.

28. The boat of claim 26, wherein the at least one multi-element hinge provides articulation of the bow with a compound locus.

29. The boat of claim 21, wherein the at least one back member is at least one locking pin which cooperates with at least one bow locking plate and at least one stern locking plate, the at least one bow locking plate fixedly secured to the bow and the at least one stern locking plate fixedly secured to the stern, the at least one locking pin being receive in a locking opening formed in each of the locking plates.

30. The boat of claim 29, wherein there are a plurality of locking pins and locking plates, and at least some of the locking pins are each associated with a connector arm and each connector arm is associated with a rotatable boss.

31. The boat of claim 30, wherein there are two rotatable bosses connected by a boss connector arm.

* * * * *